US011413899B1

(12) United States Patent
Thies

(10) Patent No.: US 11,413,899 B1
(45) Date of Patent: Aug. 16, 2022

(54) FOLDED BROCHURE WITH INTERNAL POUCH, AND METHOD OF MANUFACTURING BROCHURES

(71) Applicant: THE CHALLENGE PRINTING CO., Clifton, NJ (US)

(72) Inventor: Kevin Thies, Lake Hopatcong, NJ (US)

(73) Assignee: The Challenge Printing Company, Clifton, NJ (US)

( * ) Notice: Subject to any disclaimer, the term of this patent is extended or adjusted under 35 U.S.C. 154(b) by 0 days.

(21) Appl. No.: 17/243,824

(22) Filed: Apr. 29, 2021

(51) Int. Cl.

| | |
|---|---|
| ***B42C 19/02*** | (2006.01) |
| ***B42C 9/00*** | (2006.01) |
| ***B42C 19/08*** | (2006.01) |
| ***B42D 15/00*** | (2006.01) |
| ***B65H 45/04*** | (2006.01) |

(52) U.S. Cl.
CPC ..... *B42C 9/0081* (2013.01); *B42C 19/02* (2013.01); *B42C 19/08* (2013.01); *B42D 15/008* (2013.01); *B65H 45/04* (2013.01)

(58) Field of Classification Search
CPC ..... B65B 9/06; B65B 11/004; B42D 15/008; B42C 19/02; B42C 19/08; B42C 9/0081; B65H 45/04
See application file for complete search history.

(56) References Cited

U.S. PATENT DOCUMENTS

| | | | | |
|---|---|---|---|---|
| 6,105,340 A * | 8/2000 | Draghetti | B65B 61/202 | 53/415 |
| 6,273,411 B1 * | 8/2001 | Vijuk | B42D 15/008 | 270/37 |
| 8,448,414 B2 * | 5/2013 | Wipf | B65D 77/003 | 53/456 |

FOREIGN PATENT DOCUMENTS

FR 3047480 A1 * 8/2017 ..... B65H 18/28

* cited by examiner

*Primary Examiner* — Leslie A Nicholson, III
(74) *Attorney, Agent, or Firm* — Greer Burns & Crain Ltd.

(57) ABSTRACT

A brochure is made by folding a single sheet of paper along a plurality of parallel longitudinal fold lines to make an interim piece. The interim piece is conveyed in the direction of the longitudinal fold lines, and folded in a right-angle direction transverse to the first direction, along transverse fold lines perpendicular to the longitudinal fold lines. A pouch is placed inside of the interim piece without adhesive, as the interim piece is folded, and the interim piece is sealed to complete the brochure. The pouch is preferably placed over one of the transverse fold lines. A label can be applied to the brochure if desired.

4 Claims, 7 Drawing Sheets

FOLDED BROCHURE WITH INTERNAL POUCH, AND METHOD OF MANUFACTURING BROCHURES

This invention relates to folded brochures, and more particularly, to folded brochures having an internal pouch or the like that is not attached by adhesive. The invention also relates methods and apparatus for making such folded brochures.

BACKGROUND OF THE INVENTION

A blister pack is a type of packaging in which multiple products such as pills are individually sealed in plastic compartments with a cardboard backing. For example, birth control pills are often packaged in blister packs because the pills can be removed one at a time, and cycles can be easily and reliably monitored because the pills are in individual compartments. A separate removable label can be provided to assist with monitoring.

Birth control pill manufacturers put the blister pack of pills in a box with a folded and glued brochure. The brochure is printed with extensive instructions, warnings and the like. It is typically made from a single piece of paper that is folded many times and sealed.

Birth control pill manufacturers can provide a wallet-like pouch in the box, in addition to the brochure. The user can place the blister pack in the pouch after removal from the box, which is convenient and desirable. However, the pouch is placed in the box separately, which is costly and inefficient. Thus, there is a need for more efficient ways to fill a box with a blister pack, a brochure and a pouch.

Accordingly, one object of this invention is to provide new and improved folded and sealed brochures.

Another object is to provide new and improved methods and apparatus for making folded and glued brochures that have a pouch or the like inside of the brochure, without adhering the pouch to the brochure.

SUMMARY OF THE INVENTION

In keeping with one aspect of this invention, a brochure is made by folding a single sheet of paper along a plurality of parallel longitudinal fold lines to make an interim piece. The interim piece is conveyed in the direction of the longitudinal fold lines and is then folded in a direction at a right-angle transverse to the first direction, along transverse fold lines perpendicular to the longitudinal fold lines. A pouch is placed inside of the interim piece without adhesive, as the interim piece is folded, and the interim piece is sealed to complete the brochure. The pouch is preferably placed over one of the transverse fold lines. A label can be applied to the brochure if desired.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
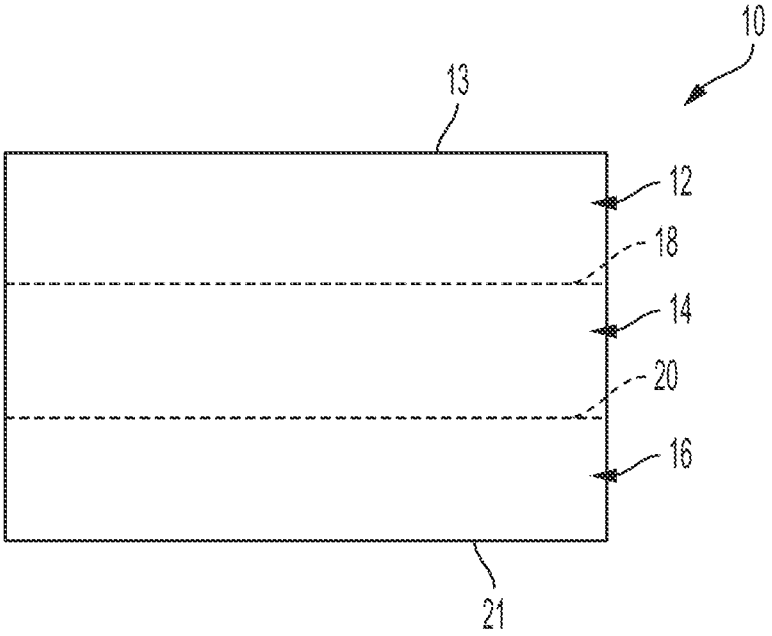
FIG. 1 is a plan view of a single sheet of paper with two longitudinal fold lines.

As seen in FIG. 1, a single sheet of paper 10 has three longitudinal panels 12, 14 and 16. The panel 12 is defined by an upper edge 13 and a parallel longitudinal fold line 18. The panel 14 is defined by the parallel fold line 18 and a parallel longitudinal fold line 20, and the panel 16 is defined by the parallel fold line 20 and a parallel lower edge 21.

The paper 10 is subjected to first stage folding by folding the panel 12 up at the fold line 18, and folding the panel 16 down at the fold line 20. This longitudinal folding process forms an interim piece 22, shown in FIG. 2. The interim piece 22 has a panel 24 formed by a left edge 23 and a fold line 25, a panel 26 formed by the fold line 25 and a fold line 27, and a panel 28 formed by the fold line 27 and a fold line 29. A panel 30 is formed by the fold line 29 and a fold line 31. A panel 32 is formed by the fold line 31 and a fold line 33, and a panel 34 is formed by the fold line 33 and a right edge 35. The fold lines 25, 27, 29, 31 and 33 are at a right-angle transverse to the longitudinal fold lines 18 and 20.

A pouch 36 is located inside of the interim piece 22 without adhesive. The pouch 36 is paper or plastic based, and is flexible. The pouch has first and second sides sealed around three edges to form the pouch 36, leaving an open top for insertion of a blister pack or the like. It is contemplated that the pouch 36 could have a flap that selectively opens and closes the open top.

Figure 2:
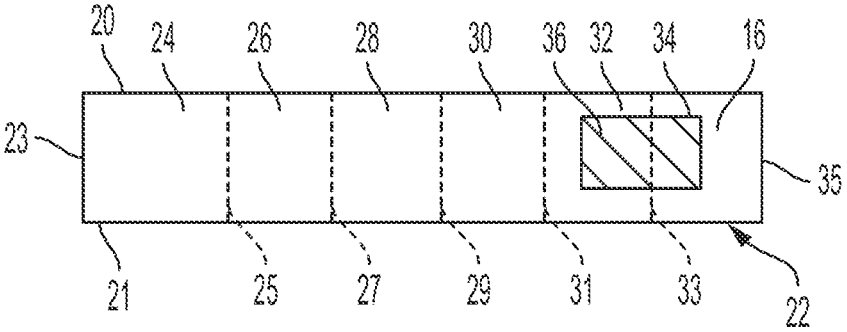
FIG. 2 is a plan view of an interim piece made from the paper in FIG. 1, with additional, right-angle transverse fold lines.

In a second folding process, the interim piece 22 is scored at the transverse fold lines 25, 27, 29, 31 and 33. The interim piece 22 is then folded at fold line 29 so that the panel 24 partially covers the panel 34, the panel 26 covers the panel 32, and the panel 28 covers the panel 30. As seen in FIG. 2, the pouch 36 is placed over the fold line 33. In this manner, the pouch 36, which spans the panels 32, 34, is covered by the panels 26, 24, respectively.

Figure 3:
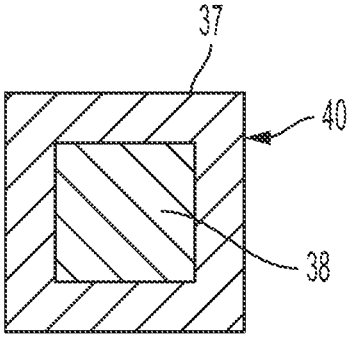
FIG. 3 is a plan view of finished product made according to the present invention.

The panels 24, 34 are then folded over the panels 26, 32 at transverse fold lines 25, 33, and the panels 28, 30 are folded over the panels 24, 34 at transverse fold lines 27, 31. The underside of the panel 30 (as viewed in FIG. 2) is then adhered to the underside of the panel 24 using adhesive to create a folded and sealed brochure 37, shown in FIG. 3. A label 38 can be adhered to the brochure 37 if desired. With or without the label 38, the sealed brochure is a finished product 40, ready for shipment to a customer.

Figure 4:
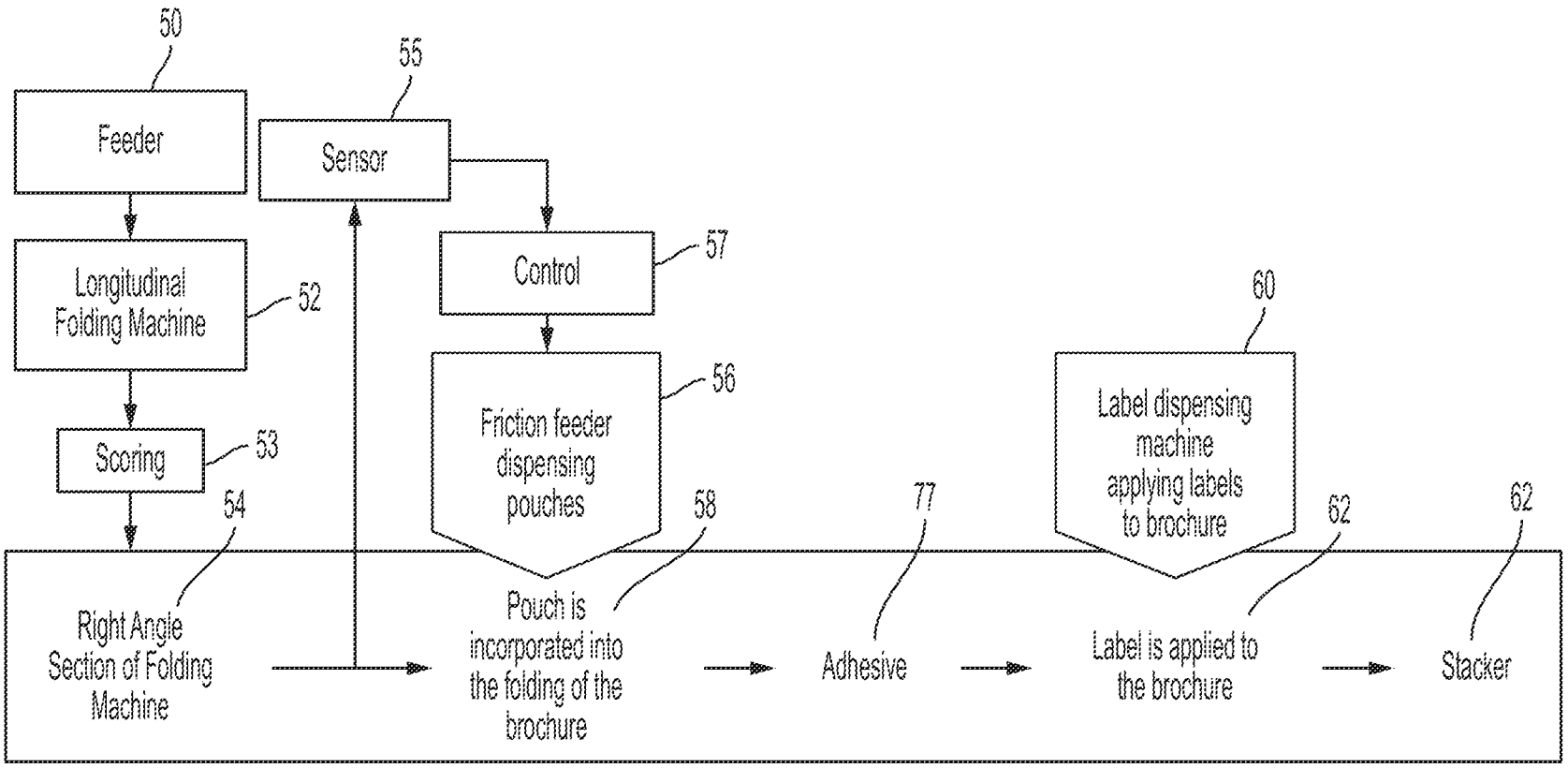
FIG. 4 is a block diagram of the machinery used to fabricate the finished product shown in FIG. 3.

A method for making the finished product 40 is shown in FIG. 4. Multiple sheets of the paper 10 are placed in a feeder 50. The sheets are individually fed to a folding machine 52, which forms the sheets 10 into the interim pieces 22. The interim pieces 22 are then fed to a scoring station 53, where transverse fold lines 25, 27, 29, 31 and 33 are scored. The interim pieces 22 are then conveyed to a right-angle section 54 of a folding machine.

Multiple pouches 36 are stacked in a friction pouch feeder 56, and are timely dispensed onto the interim pieces 22. The pouches 36 are folded into the brochures 37 as the brochures 37 are folded in the right-angle section 54, and sealed with adhesive at an adhesive station 77. Labels 38 can be adhered to the brochures 37 at a label applicator station 60 to complete the brochures 37. The finished products 40 are fed to a stacker 62 for shipment to a customer.

The machine is controlled by a controller 57. A sensor 55 sends a trigger signal to the controller 57 when it senses an interim piece 22. The controller 57 then triggers the pouch feeder 56 at the appropriate time so that a pouch 36 is placed on the interim piece 22 as the interim piece is folded in the right-angle section 54 of the folding machinery.

Figure 5:
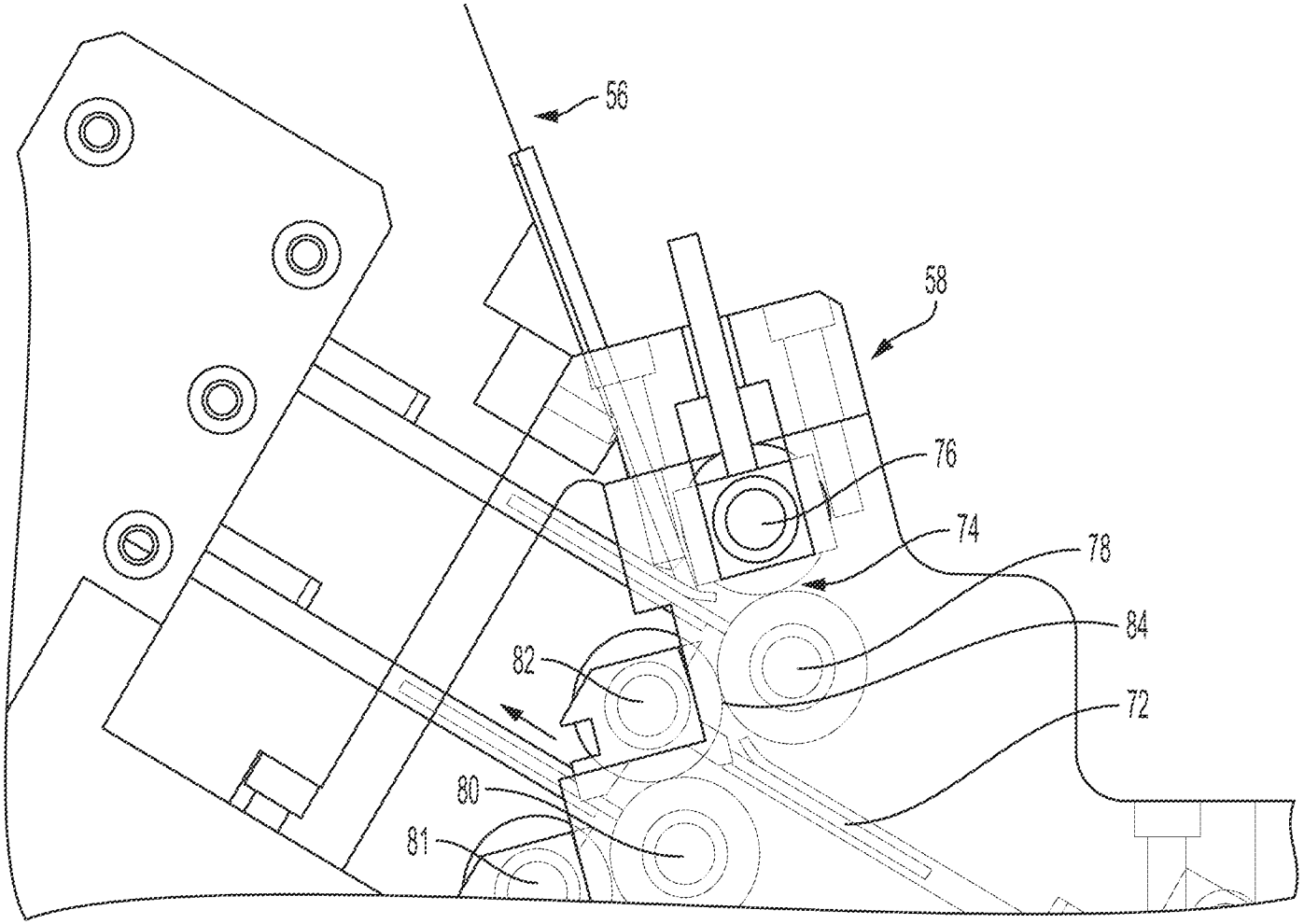
FIG. 5 is a diagram of a folding machine and pouch inserter used to fabricate the finished product of FIG. 3.

The pouch feeder 56 and the right-angle section 54 are shown in more detail in FIGS. 5 and 6A-6D. The right-angle section 45 has an infeed table 70 that brings the interim pieces 22 to a folding station 58. When the interim piece 22 passes under the sensor 55, a signal is sent to the controller 57. The interim piece 22 is guided to a gap 74 between rollers 76, 78 (FIG. 5). When about half of the interim piece 22 has passed between the rollers 76, 78 (FIG. 6B), the direction of the interim piece 22 is reversed, and the interim piece 22 is fed to a second set of rollers 78, 82. At the same time, a pouch 36 is fed from the pouch feeder 56 to the interim piece 22 through an opening 79 (FIG. 6C) in a cover 85 in the folding station 58. The timing of the pouch feeder 56 is set so that the pouch 36 covers the fold line 33, and the interim piece 22 is immediately folded at the fold line 29. The pouch 36 is then captured between two portions of the interim piece, namely panels 30, 32 and 34 on one side of the pouch 36, and panels 24, 26 and 28 on the other side of the pouch 36. This operation partially captures the pouch 36 in the interim piece 22, without adhesive.

Figure 6A:
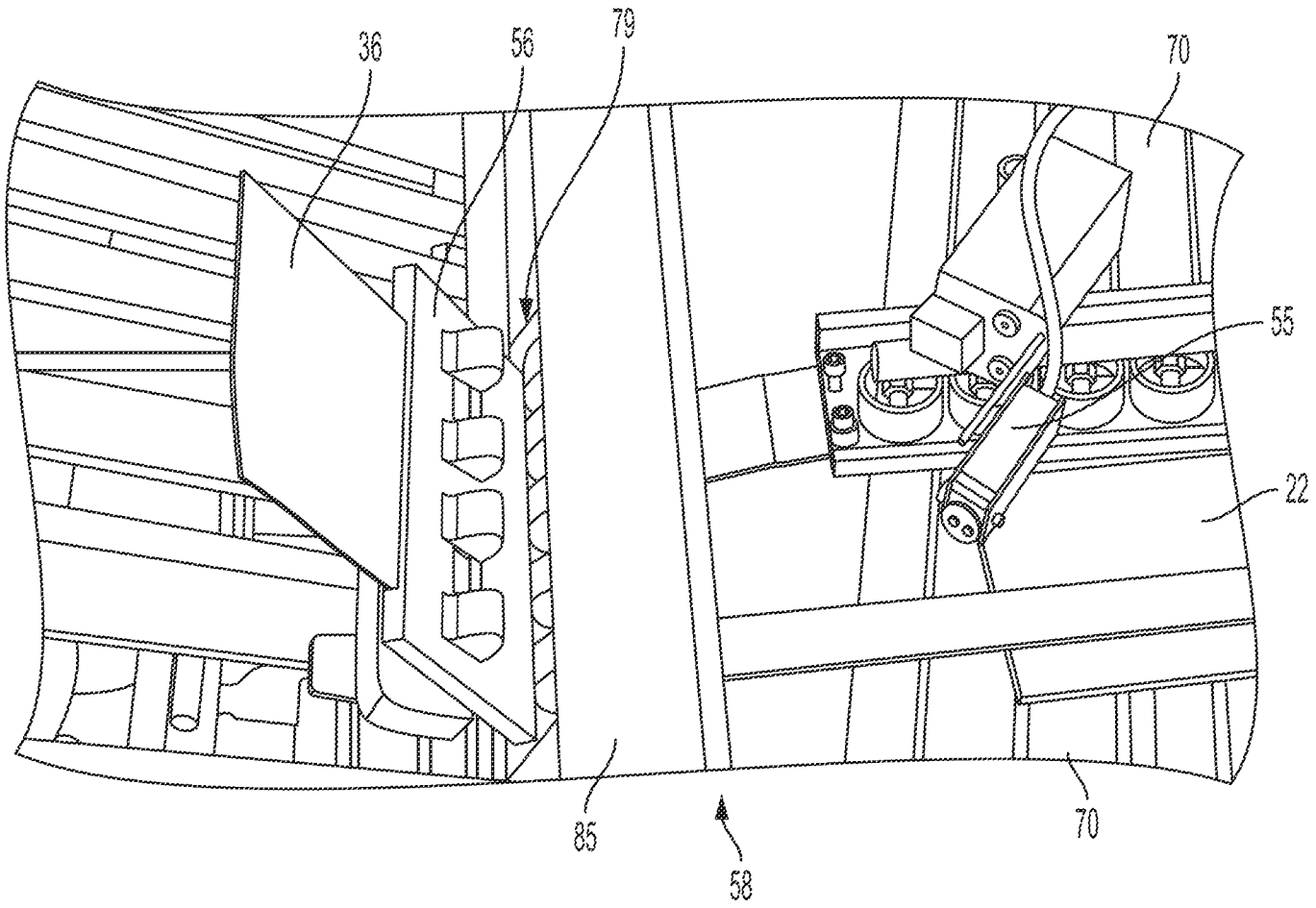
FIGS. 6A, 6B, 6C and 6D are detail views of part of the machinery used to fabricate the finished product of FIG. 3.
Figure 6B:
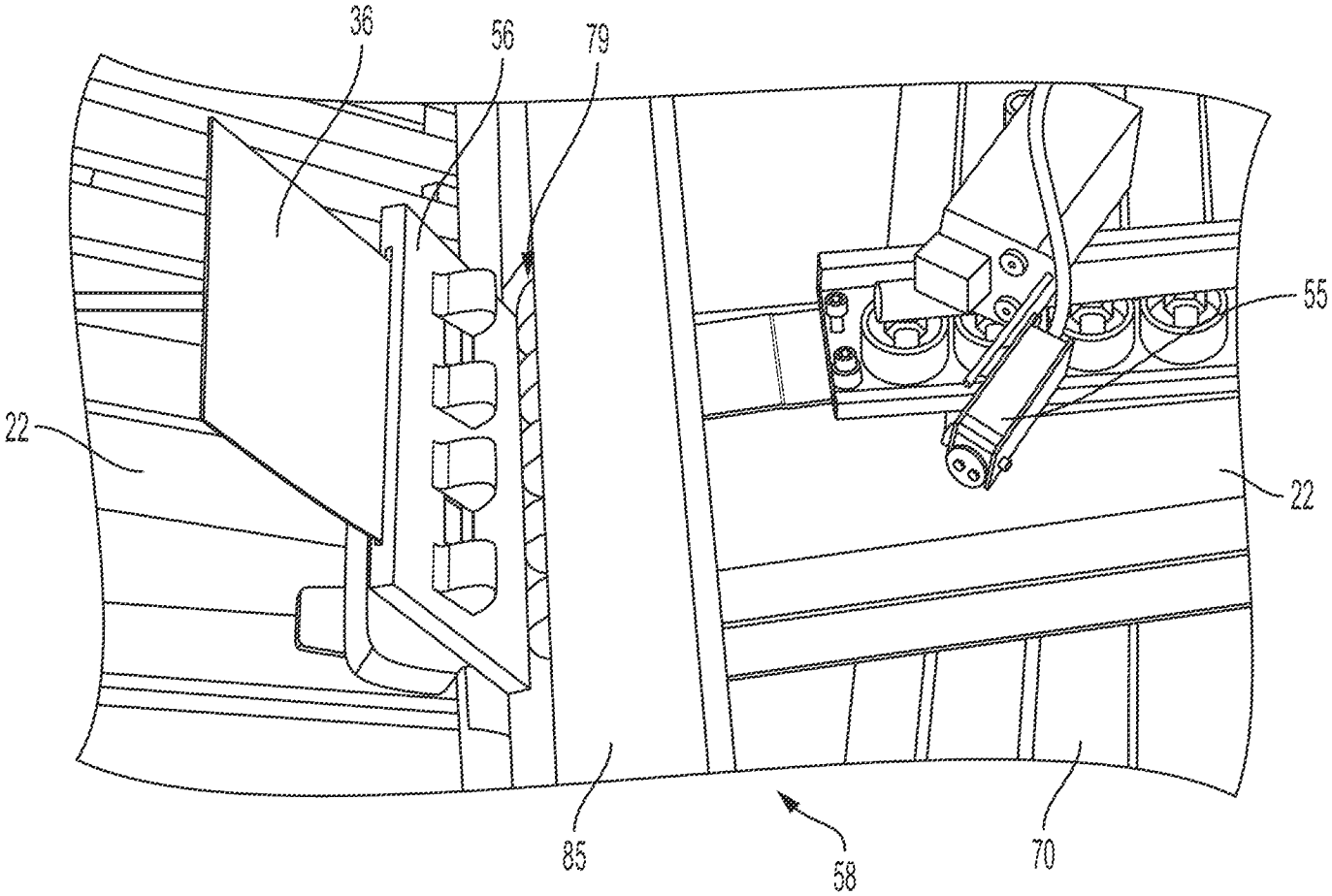
Figure 6C:
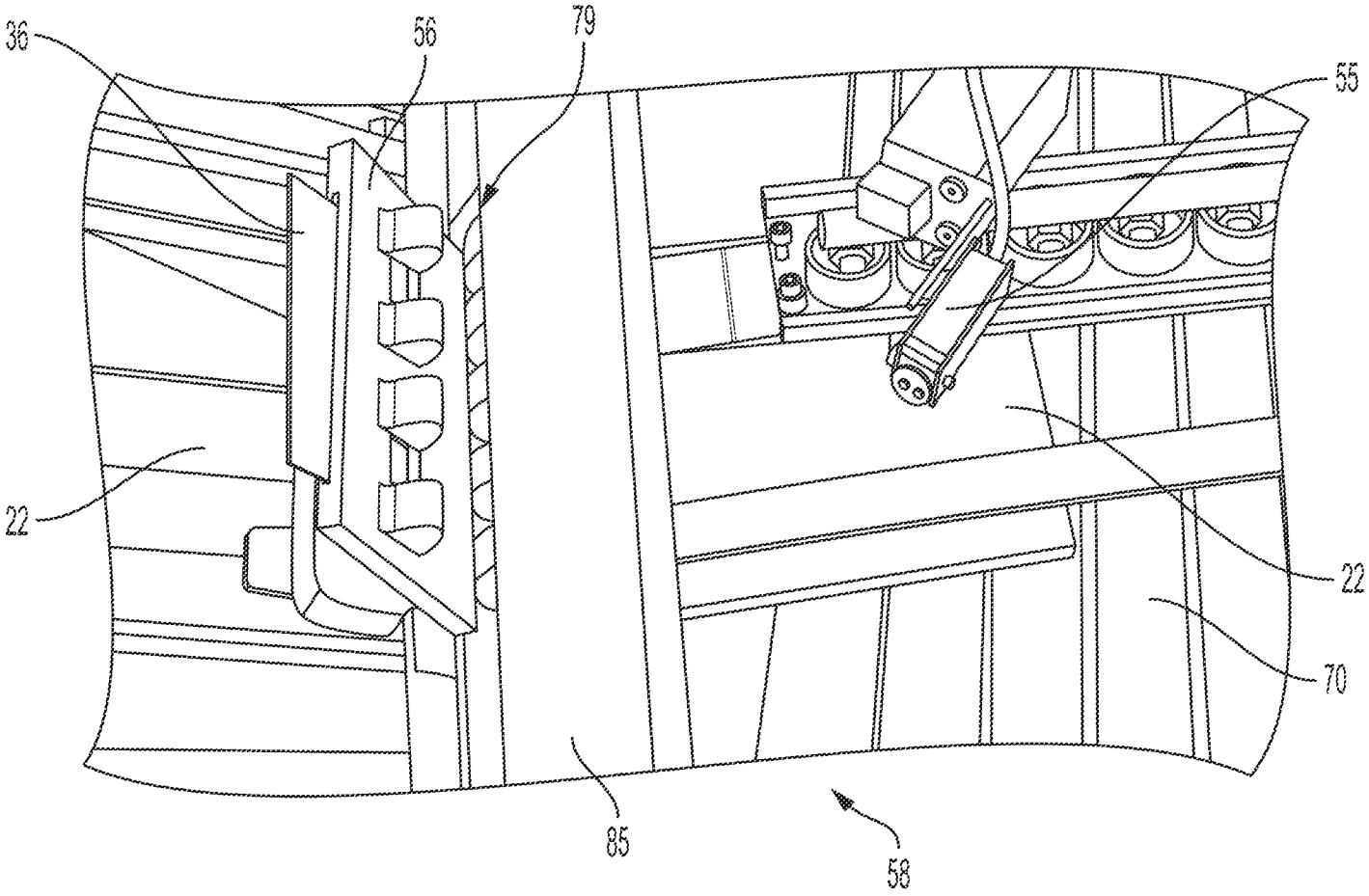
Figure 6D:
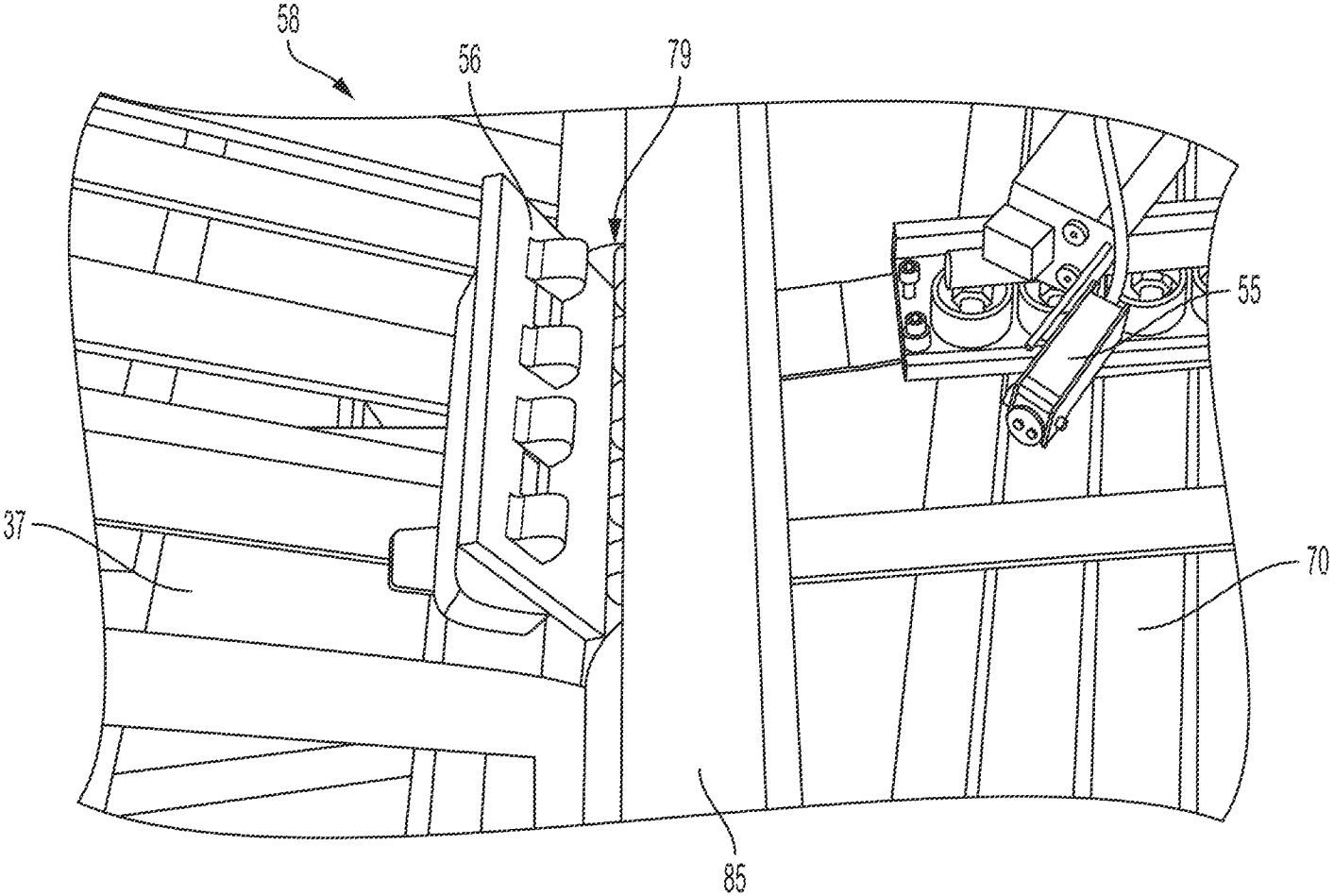

The interim piece 22, now folded at the fold line 29, is folded again at the fold lines 25, 33, which overlap, and the fold lines 27, 31, which also overlap, by passing between rollers 78, 82 to a plate 72, through rollers 82, 80, through rollers 80, 81. Folding at the fold line 33 also folds the pouch 36, fully securing the pouch 36 in the interim piece 22. The then folded brochures leave the folding station 58 through the rollers 80, 81 (FIG. 6D).

The panel 24 is adhered to the panel 30 at a sealing station 77 (FIG. 4), which seals the brochure. A label 38 can be applied at the station 60 to make the finished products 40, and the products 40 can be stacked at a stacking station 62 to shipment to a customer.

In the case of birth control pills, a user removes a blister pack of pills and a folded brochure from a carton. When the adhesive seal of the brochure is broken and the brochure is opened along the transverse fold lines, the pouch is evident and can be easily removed. The brochure can then be unfolded along the longitudinal fold lines, exposing all of the written information in the brochure.

Advantages of the invention are now apparent. The pouch is secured inside of the brochure without adhesive, in a continuous operation, which is efficient and cost effective. Moreover, the pouch can easily be retrieved by the end user. The pouch can be removed by breaking the adhesive bond and unfolding the brochure at one or more transverse fold lines, without unfolding the brochure at the longitudinal fold lines. The brochure can then be unfolded at the transverse fold lines to read the entire brochure.

While the principles of the invention have been described above in connection with specific apparatus and applications, it is to be understood that this description is made only by way of example and not as a limitation on the scope of the invention.

What is claimed is:

1. A method of making a brochure comprising:

folding a single sheet of paper along a plurality of parallel first longitudinal fold lines to make an interim piece, conveying the interim piece in a direction of the longitudinal fold lines, and folding the interim piece in a right-angle direction transverse to the longitudinal direction, along transverse fold lines perpendicular to the longitudinal fold lines, placing a pouch inside of the interim piece without adhesive, as the interim piece is folded, the pouch being located over a selected transverse fold line in the interim piece, and sealing the interim piece to produce the brochure, wherein the single sheet of paper has two parallel longitudinal fold lines that define three longitudinal panels, the interim piece being formed by folding a first longitudinal panel in a first direction with respect to a second longitudinal panel, and folding a third longitudinal panel in a second direction opposite to the first direction, wherein further the interim piece includes first, second, third, fourth and fifth transverse fold lines, a first transverse edge and a second transverse edge, the first transverse edge and the first fold line form a first longitudinal panel, the first fold line and the second fold line form a second panel, the second fold line and the third fold line form a third panel, the third fold line and the fourth fold line form a fourth panel, the fourth fold line and the fifth fold line form a fifth panel, and the fifth fold line and the second transverse edge form a sixth panel, the pouch being place on the fifth fold line so as to extend at least partially over the fifth panel and the sixth panel, wherein the interim piece is folded at the third fold line after the pouch is placed on the fifth fold line, so that the first and second panels at least partially cover the pouch, the fifth fold line and the first fold line are aligned with each other, and the second fold line and fourth fold line are aligned with each other, the interim piece then being folded at the fifth fold line and the first fold line, the interim piece then being folded at the second fold line and the fourth fold line, the first panel then being adhered to the fourth panel to seal the interim and complete the brochure.

2. A method of making a brochure comprising:

folding a single sheet of paper along a plurality of parallel first longitudinal fold lines to make an interim piece, conveying the interim piece in a direction of the longitudinal fold lines, and folding the interim piece in a right-angle direction transverse to the longitudinal direction, along at least one transverse fold line perpendicular to the longitudinal fold lines, the at least one transverse fold line being flanked by a first longitudinal panel adjacent one side of each transverse fold line and a second longitudinal fold line on an opposite side of each transverse fold line, placing a pouch across the at least one transverse fold line and the first and the second longitudinal panels adjacent the at least one transverse fold line without adhesive, as the interim piece is folded, the pouch being folded across the at least one transverse fold line in the interim piece, and sealing the interim piece to produce the brochure.

3. The method of claim 2 comprising conveying the brochure to a label applicator, and applying a label to the brochure.

4. The method of claim 2 wherein the single sheet of paper has two parallel longitudinal fold lines that define three longitudinal panels, the interim piece being formed by folding a first longitudinal panel in a first direction with respect to a second longitudinal panel, and folding a third longitudinal panel in a second direction opposite to the first direction.

* * * * *